US005617744A

United States Patent [19]

Conti

[11] Patent Number: 5,617,744

[45] Date of Patent: Apr. 8, 1997

[54] DEVICE FOR THE AUTOMATIC FORMATION OF A CLOSED TOE IN A TUBULAR KNITTED ARTICLE

[75] Inventor: Paolo Conti, Florence, Italy

[73] Assignee: Golden Lady S.p.A., Jesi, Italy

[21] Appl. No.: 596,185

[22] PCT Filed: Jun. 7, 1995

[86] PCT No.: PCT/IT95/00099

§ 371 Date: Apr. 26, 1996

§ 102(e) Date: Apr. 26, 1996

[87] PCT Pub. No.: WO95/34702

PCT Pub. Date: Dec. 21, 1995

[30] Foreign Application Priority Data

Jun. 16, 1994 [IT] Italy ..... FI94A0125

[51] Int. Cl.[6] ..... D04B 9/56

[52] U.S. Cl. ..... 66/148; 66/58

[58] Field of Search ..... 66/8, 13, 58, 148

[56] References Cited

U.S. PATENT DOCUMENTS

| | | | |
|---|---|---|---|
| 1,308,828 | 7/1919 | Williams | 66/58 |
| 2,089,147 | 8/1937 | Lawson et al. | 66/58 X |
| 5,551,260 | 9/1996 | Frullini et al. | 66/148 |

FOREIGN PATENT DOCUMENTS

| | | |
|---|---|---|
| 0592376 | 4/1994 | European Pat. Off. . |
| 1346518 | 11/1963 | France . |
| 1635992 | 7/1971 | Germany . |
| 676845 | 11/1964 | Italy . |
| 685974 | 3/1965 | Italy . |

*Primary Examiner*—John J. Calvert
*Attorney, Agent, or Firm*—McGlew & Tuttle

[57] ABSTRACT

A plurality of hooks (23U) is capable of engaging the initial hem of a pocket (MP) formed by the needles (7X) of a sector covering approximately a semicircumference, and of transferring the said initial hem to the needles of the other opposite sector of needles; the said hooks (23U) are disposed at the ends of rods (23) which are elastically flexible and moved longitudinally; a curved support (47) is hinged so that it can oscillate about an axis which is diametric with respect to the circumferential working area of the needles (7) of the cylinder (1); radial sliding passages for the individual rods are formed radially in the said support.

7 Claims, 14 Drawing Sheets

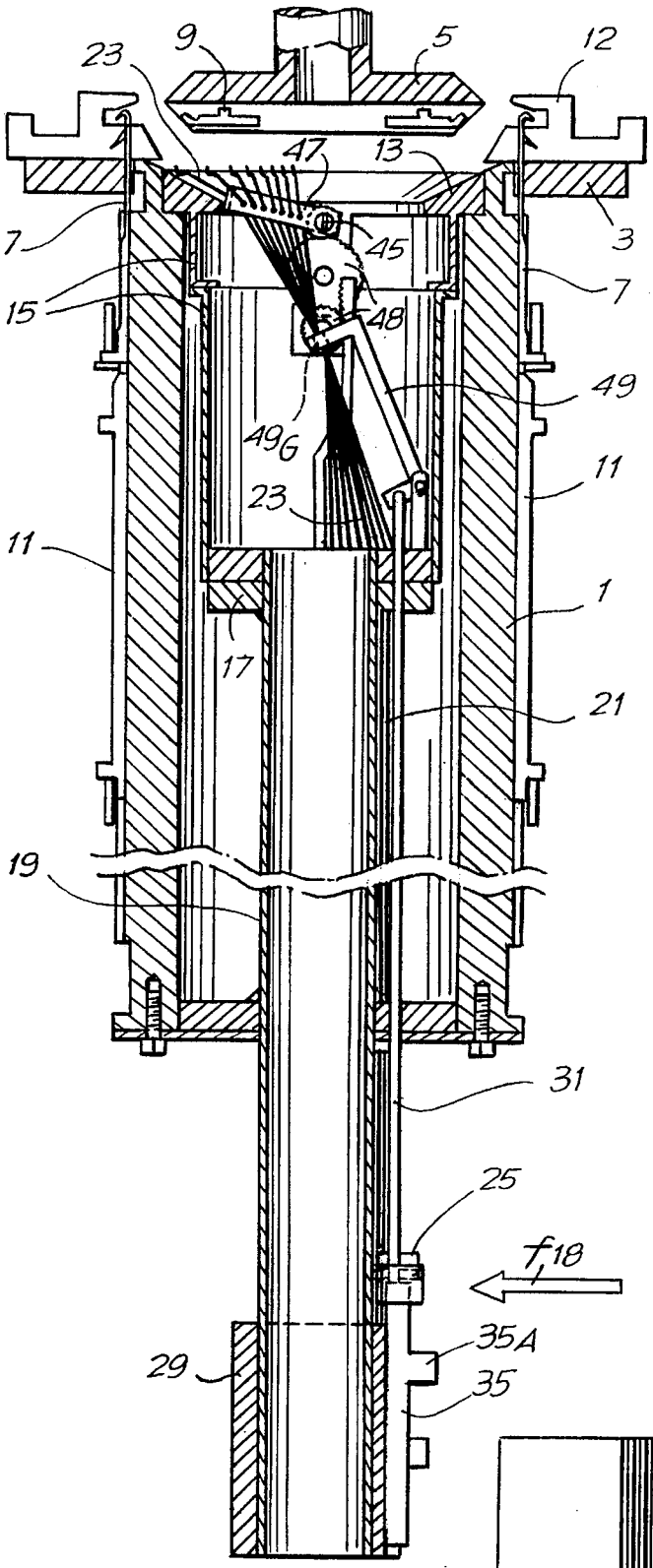
Fig. 6
Fig. 6A
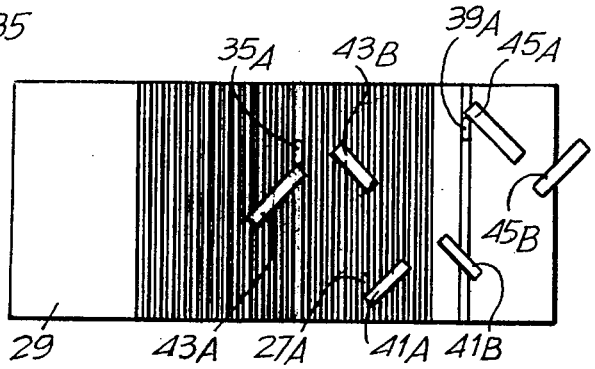

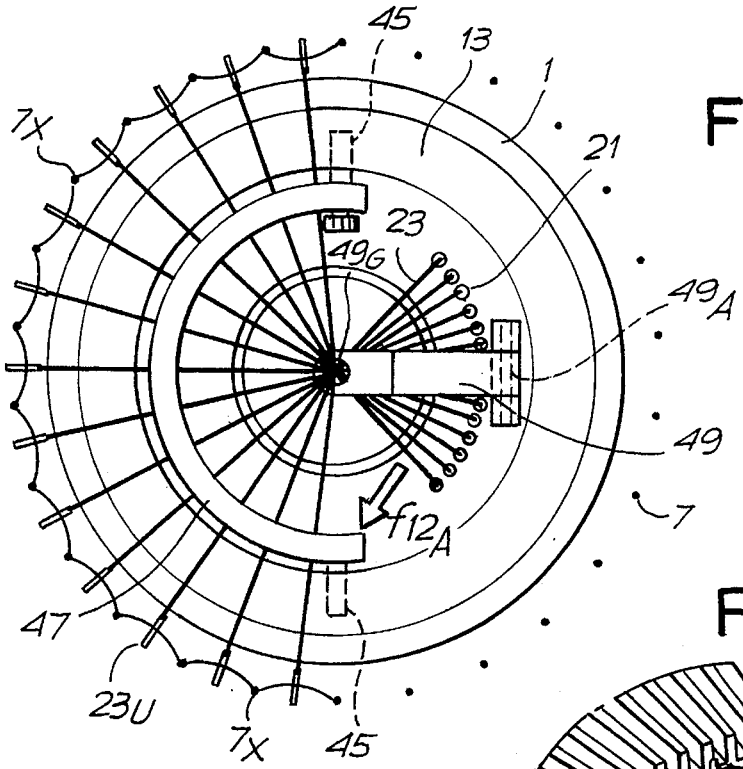
Fig.12
Fig.12A
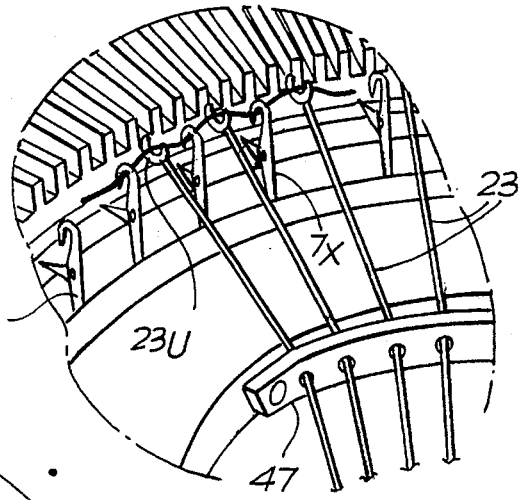
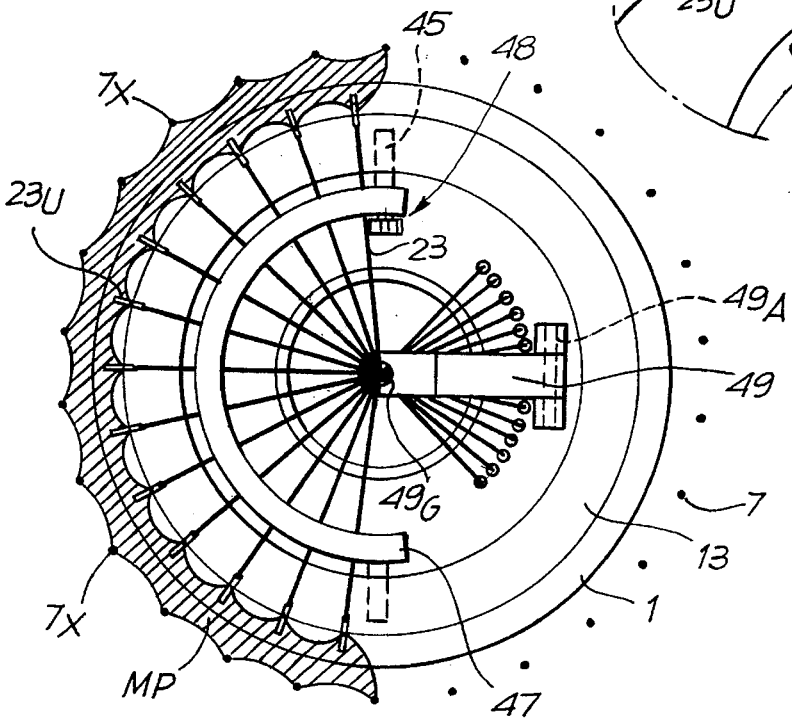
Fig.13

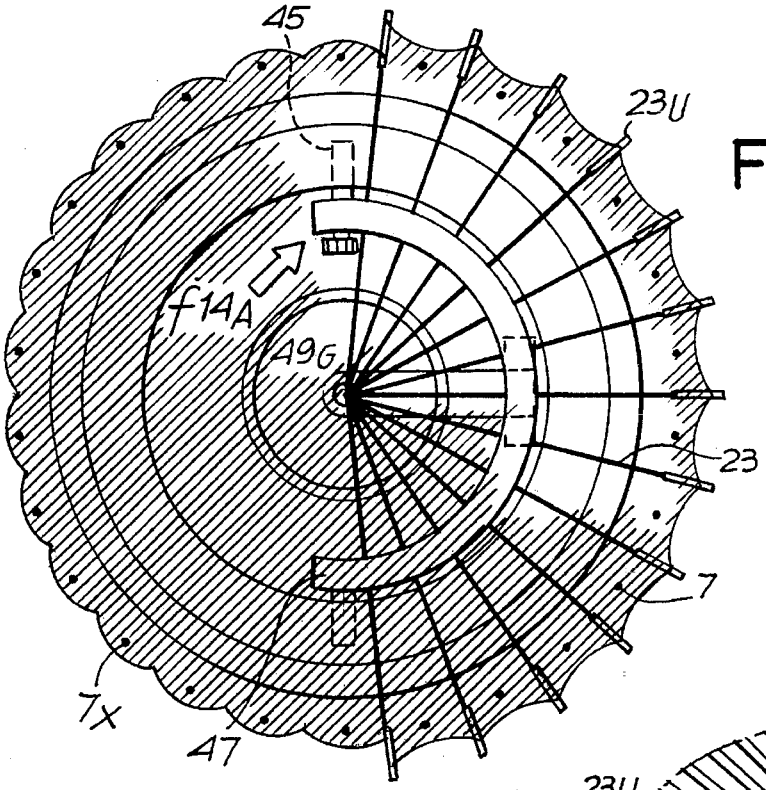
Fig.14
Fig.14A
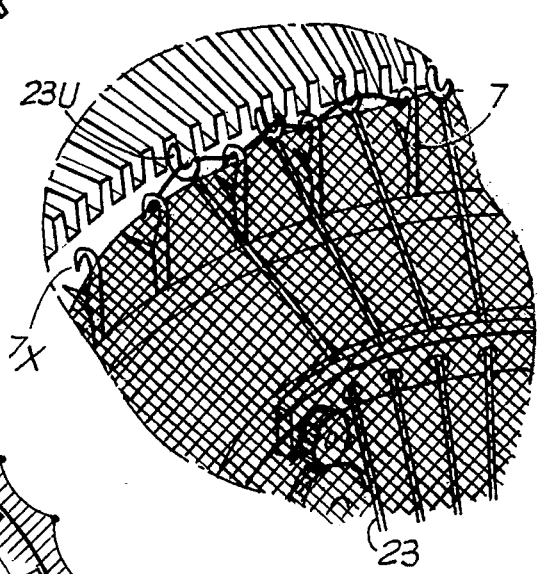
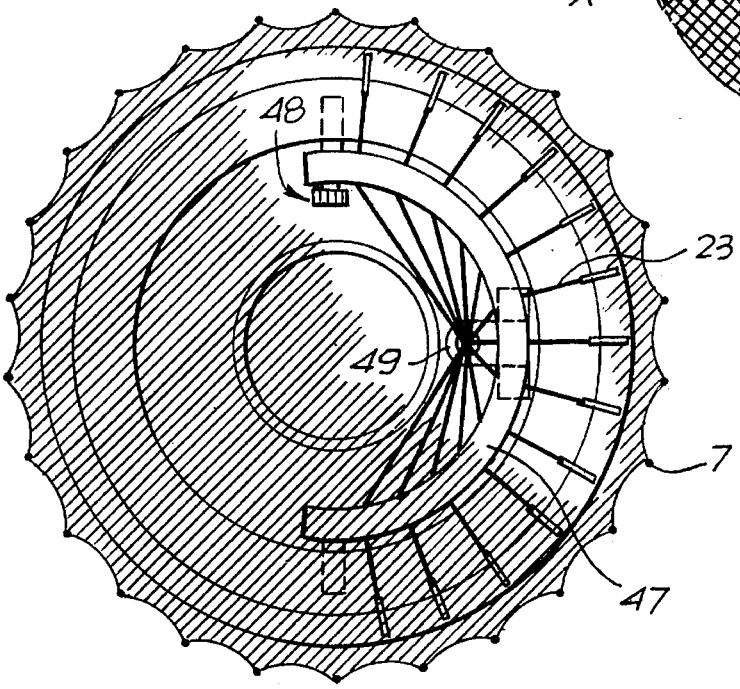
Fig.15

DEVICE FOR THE AUTOMATIC FORMATION OF A CLOSED TOE IN A TUBULAR KNITTED ARTICLE

DESCRIPTION

1. Technical Field

The invention relates to an improvement of the device described in Italian Patent No. 1,252,799 (Application 13.9.91 FI 91 A 227 in the name of Giovanna Bazzanti) for the automatic initial formation of a closed toe in a tubular knitted article—such as a sock, a stocking or the leg of tights—directly on the circular knitting machine with a needle cylinder on which the said article is formed. This device comprises a plurality of hooks capable of engaging the partial initial fabric of a pocket formed by the needles of a sector covering approximately a semicircumference, the said needles being capable of transferring the said initial hem to the needles of the other, opposite sector of needles, before the start of the circular knitting of the article.

2. Background Art

Before the above mentioned Italian patent application n. FI91A227, other attempts have been made to close the toe of the stocking directly on the circular knitting machine.

Italian patents n. 676.845 and 685.974 to Giuliano Ugolini disclose the closing of the toe, upon completion of the knitted tubular article, by means of a device which replaces the normal dial plate. It is therefore impossible to knit a double hem, which requires use of the dial hooks.

Italian patent n. 1.205.775 to Schiavello also discloses the closing of the toe upon completion of the tubular article. The transfer of the loops upon closing of the toe should be provided by mechanical members whose functionality is not convincing.

All these prior art devices, moreover, have the drawback of a relatively coarse end (unthread portion) protruding from the article at the toe region.

Italian patent application n. 9465 A/90, filed Aug. 10, 1990 in the name of Conti Florentia and Italian patent application n. FI 91 A227 filed Sep. 13, 1991 in the name of Bazzanti, disclose an apparatus which allow to begin the working of the article starting from a closed toe on the same machine on which the article is then completed. These machines have several functional complications which are eliminated by the present invention.

3. Disclosure of the Invention

According to the present invention, the said hooks are disposed at the ends of rods which are elastically flexible; these rods are moved longitudinally by cams of a ring of cams surrounding the needle cylinder. The rods are suitably guided as they slide; one of the guide means provided for the axial sliding of the said rods is a curved support which is hinged so that it can oscillate about an axis which is diametric with respect to the circumferential working area of the needles of the needle cylinder, radial sliding passages for the individual rods being formed radially in this support. Means are provided to move the said support between two substantially opposite positions to cause the overturning of the hooks and consequently the transfer of the said hem.

One of the means for guiding the said rods may also be a traversing element with a guide means which moves the rods into a working position which is substantially central with respect to the needle cylinder, and into a position displaced to one side in the inactive state of the hooks, to permit the passage and the tensioning—especially by pneumatic means—of the article being formed after the production of the toe. These guide means on the traversing element may also be made in such a way that they bring the rods together or at least closer to each other.

The means of guiding and moving the rods are disposed over an arc of the circumference of the needles, on one side of the axis of the support which is the side corresponding to the inactive states of the hooks during the formation of the leg.

The means of guiding the rods may comprise tubes or equivalent elements in which the rods are guided parallel to the axis of the cylinder; the said tubes or equivalent elements are disposed over an arc of the circumference of the section of the needle cylinder.

BRIEF DESCRIPTION OF THE DRAWINGS

The invention will be more clearly understood from the description and the attached drawing, which shows an embodiment, provided by way of example and without restriction, of the invention. In the drawing.

FIGS. 6 to 10 show the various configurations of the principal elements of the machine in a section along a plane passing through the axis of the needle cylinder and orthogonal to the axis of oscillation of a hook guide support;

FIGS. 6A to 10A are local views of cams for moving the hook rods;

FIGS. 12 to 15 are highly schematic plan views;

FIGS. 12A to 14A are local perspective views in the direction of the arrows f12 in FIG. 12 and f14 in FIG. 14;

DETAILED DESCRIPTION OF THE PREFERRED EMBODIMENT

Figure 18:
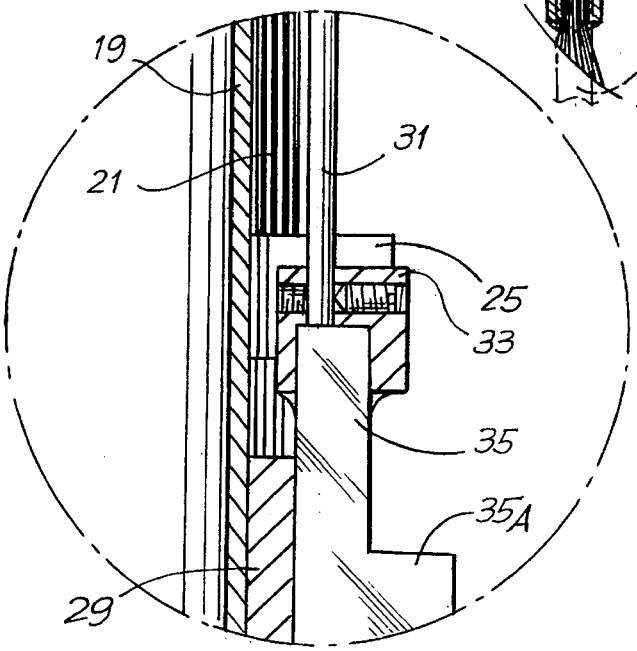
FIG. 18 is an enlarged detail seen in the direction of the arrow f18 in FIG. 6.

According to the illustration in the attached drawing, the number 1 indicates schematically the needle cylinder with which a rim 3 for the sinkers is associated; the number 5 indicates the hook disc or dial conventionally used in these single-cylinder machines for the manufacture of stockings or similar. The number 7 indicates the needles, 9 indicates the hooks of the dial or disc 5, 11 indicates the selectors or jacks for selecting the needles according to the fabric to be produced in the tubular part of the article; and 12 indicates the sinkers. Inside the needle cylinder 1, in its upper part, under a shaped ring 13 more or less conventionally disposed in the working area of the needle cylinder, there is provided a collar 15 made of two tubular sections with different diameters; this collar 15 supports at its lower end—through a flange 17—a tubular collar 19 which has externally, over an arc of its circular section (practically over a semicircumference), a plurality of tubes 21 to guide the axial sliding of corresponding flexible rods 23. Each of these rods 23 is engaged in a corresponding sliding block 25 (see also FIG. 18) which is suitably guided; each block 25 is in turn engaged with a slider 27 which slides in a corresponding groove of a further grooved cylinder 29 similar to the needle cylinder; stubs 27A of the individual sliders 27 project from the cylinder 29 and can be moved by a ring of cams which surrounds the said grooved cylinder 29 to act on the stubs 27A. FIGS. 6A to 10A show a development in the plane of the grooved cylinder 29 with the superimposition of the cams for moving the stubs 27A, one of which is visible in the said figures. The tubes 21 are extended around a sector or arc which does not exceed a semicircumference. In a central position with respect to this sector or arc, a further rigid rod 31 is provided and is engaged with a sliding block 33 which in turn is integral with a slider 35 provided with a stub 35A which interacts with a further pair of cams of the ring of cams surrounding the grooved cylinder 29. An additional rigid rod 37, which is moved through a stub 39A by another pair of cams, is provided at one end of the said sector or arc in which the rods 23 and the sliders 27 with the stubs 27A are located; the rigid rod 37 carries at its top a rack 37C for the purposes stated below.

Two cams, namely a raising cam 41A, and a lowering cam 41B, are provided to interact with the stubs 27A (see in particular FIGS. 6A–10A). Two cams, namely a raising cam 43A and a lowering cam 43B, are provided to interact with the stub 35A of the rod 31. Two cams, namely a lowering cam 45A and a raising cam 45B, are provided to interact with the stub 39A of the rod 37 of the rack 37C for the functions stated below.

Figure 8:
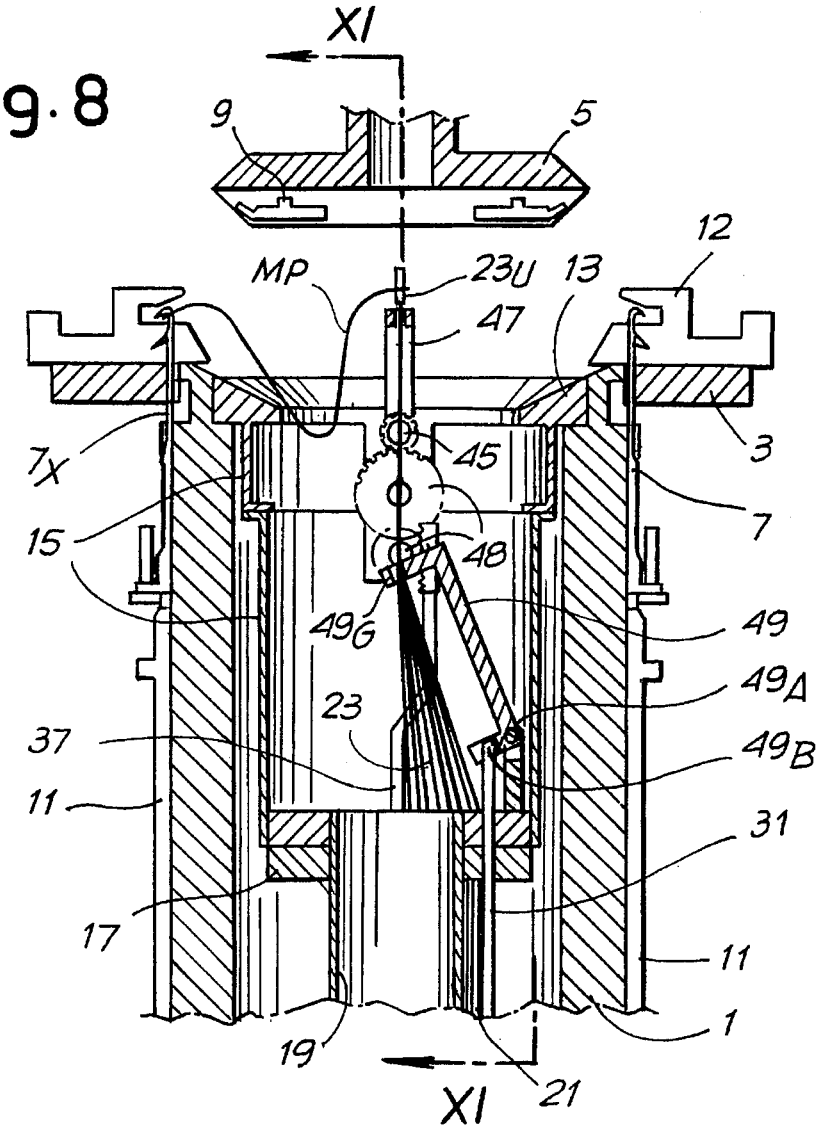
Figure 8A:
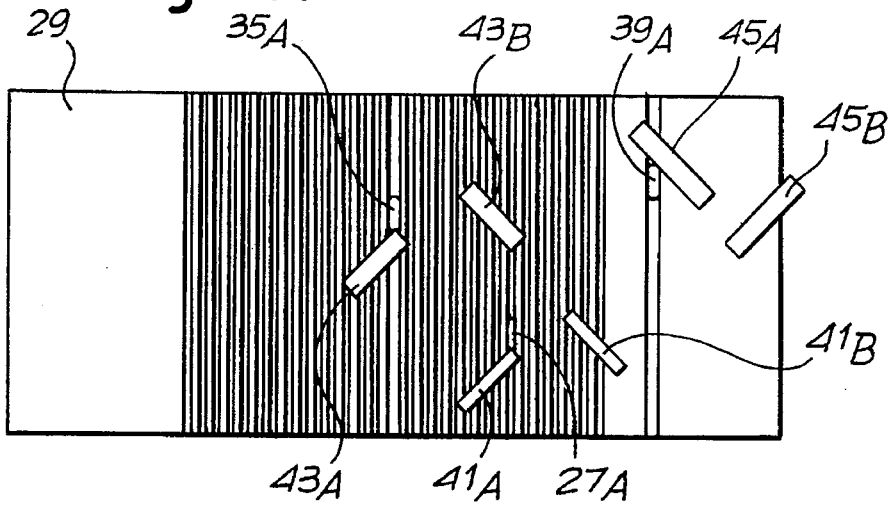
Figure 9:
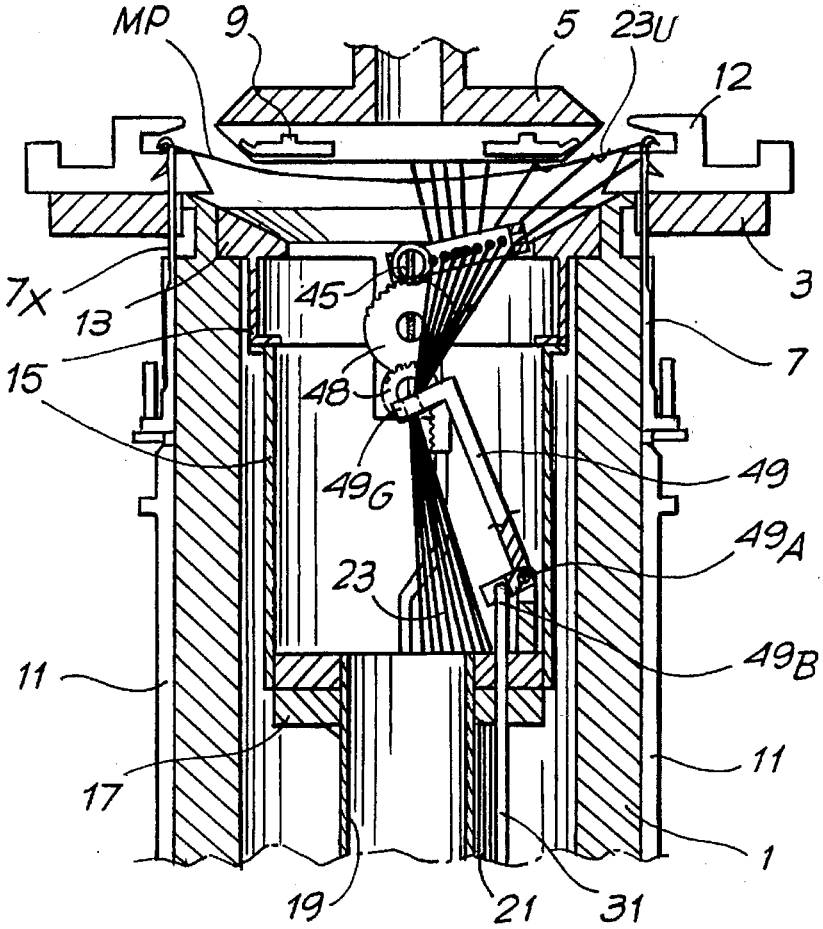
Figure 9A:
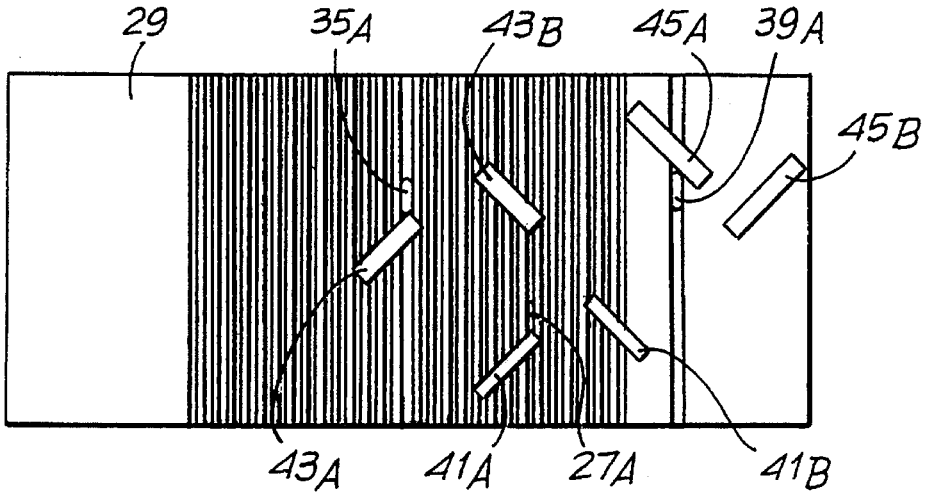
Figure 10:
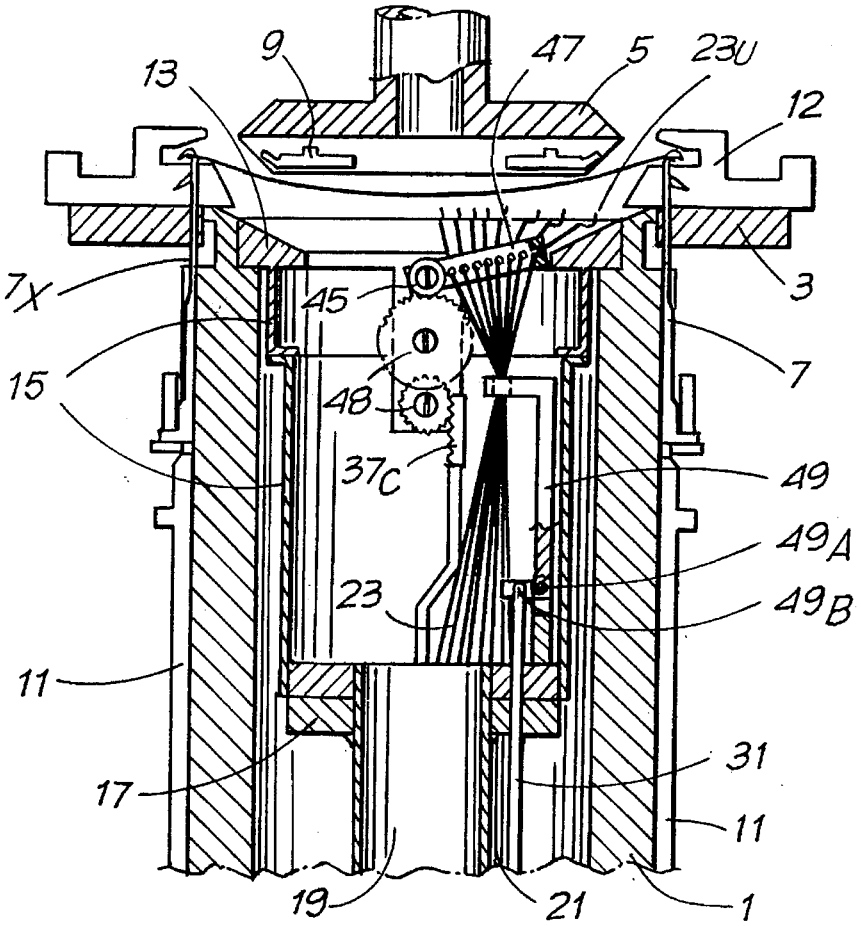
Figure 10A:
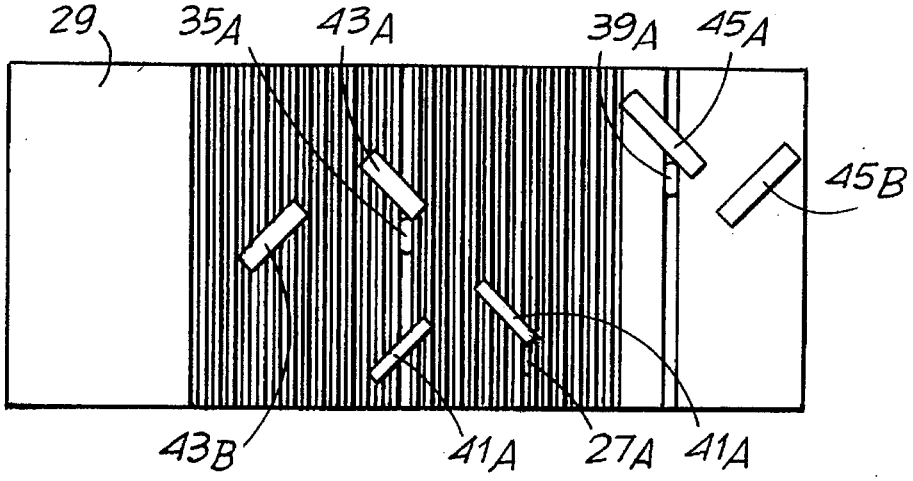
Figure 11:
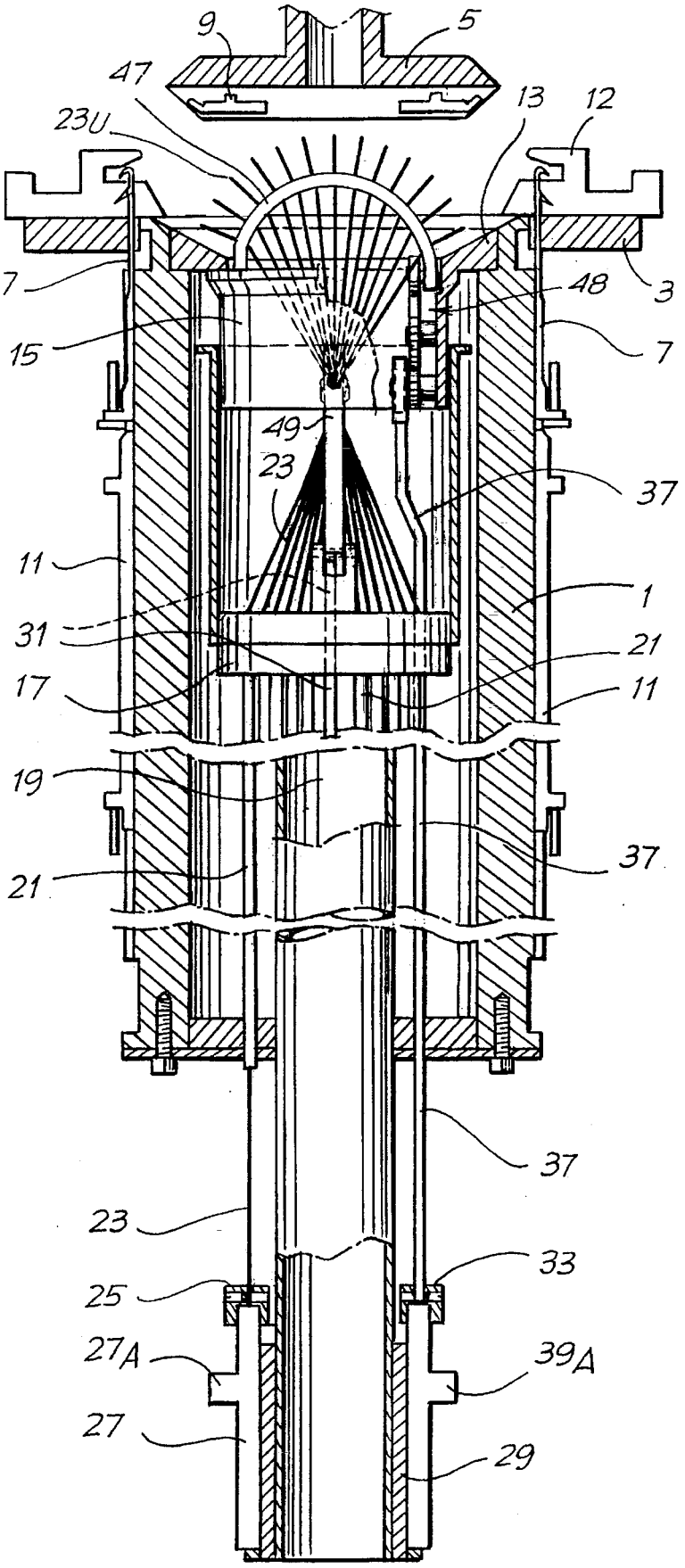
FIG. 11 is a section through XI—XI in FIG. 8.
Figure 16:
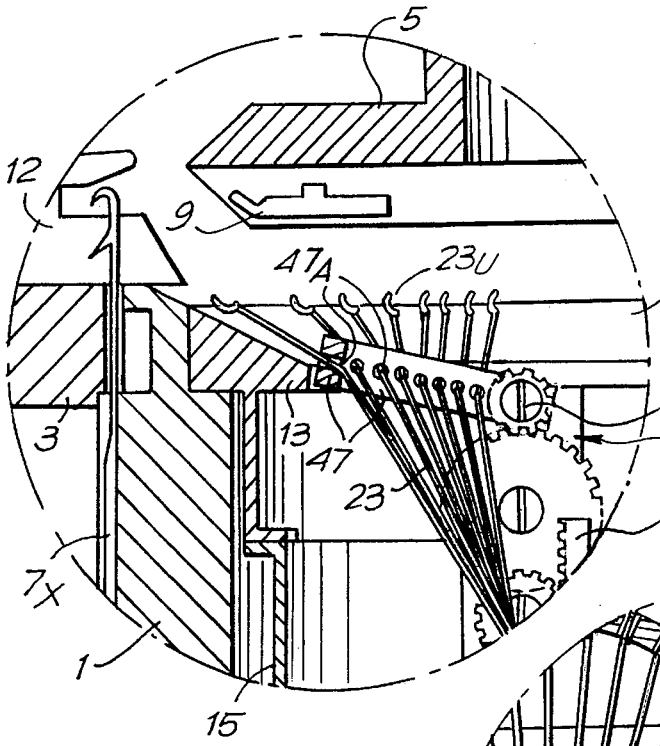
FIG. 16 is a detail of FIG. 6, enlarged.
Figure 17:
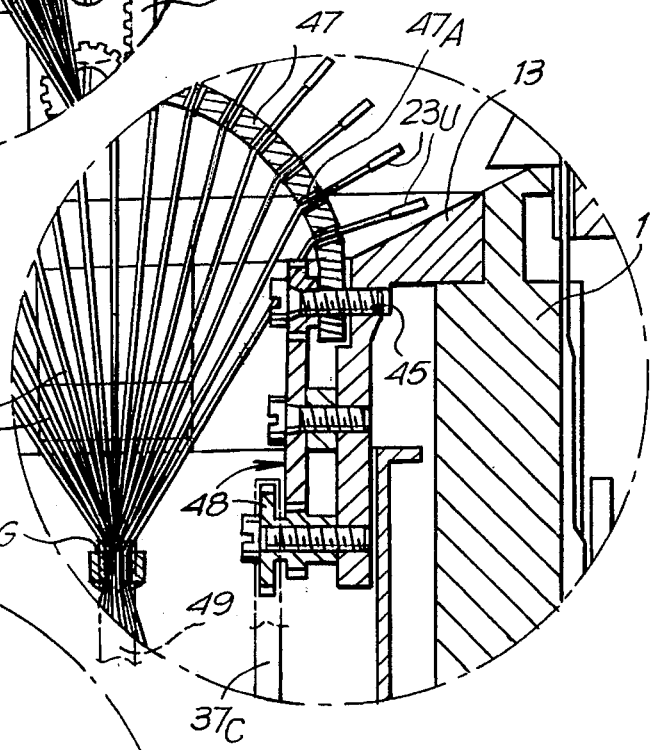
FIG. 17 is an enlarged detail, in section, of FIG. 11.

The plane of symmetry of the arc in which the elastically flexible rods 23 are located is that of the sections shown in FIGS. 6 to 10, and is perpendicular to the plane of the section shown in FIG. 11. A support 47, whose radius of curvature is substantially equal to that of the inner edge of the ring 13, within which edge this approximately semicircular support 47 can be housed in the lowered position shown in FIG. 6 or in the symmetrical overturned position shown in FIG. 9 and FIG. 16, is hinged by means of pins 45 orthogonally to the said plane of symmetry. The support 47 can be moved—through a transmission 48—by means of the rack 37C as a result of the axial movements of the rigid rod 37 moved as indicated above by the cams 45A and 45B which act on the stub 39A of the slider which slides in the cylinder 29. The operation of raising and lowering this stub 39A causes the overturning of the support 47 between the two positions shown in FIGS. 6 and 9 or 10, passing through the intermediate position shown in FIG. 8.

In the area of the upper end of the rigid rod 31, there is provided on the flange 17 a support 31A to which is hinged at 49A an element 49 which is movable angularly in the said plane of symmetry by being hinged at 49B to the end of the rod 31; the end of the element 49 opposite the hinge 49A is movable approximately radially. The element 49 forms a guide means 49G which is substantially central in the working position shown in FIGS. 1, 2 and 7; therefore the elastically flexible rods 23 extend above the fan-shaped flange 17, emerging from the ends of the tubes 21 and being concentrated at the guide end 49G of the moving element 49, and then diverging again in the form of a fan until they reach the support 47; this support has through holes 47A with their inner ends flared in the shape of funnels and the outer radial guide ends relatively extended; above the centred guide means 49G, each rod 23 reaches one of said holes 47A of support 47, thus obtaining said fan-shaped arrangement; each rod 23. The flexible and elastic rods 23 extend, still in the form of a fan, beyond the support 47, in other words beyond the guide holes 47A formed in the said support 47. The rods 23 form double hooks 23U at their ends, for the purposes stated below.

The sliding of the elastic rods 23 by means of the stubs 27A and the corresponding cams 41A, 41B causes the sliding of the corresponding hooks 23U, outside the support 47 and with a movement of the hooks 23U substantially in a radial outward direction and with respect to the support 47, as a result of the direction imparted to each rod 23 by the guide holes 47A of the support. In other words, each elastic rod 23 is guided by its own slider 27, by its own sliding block 25, by the tubes 21, by the concentrating guide 49G and by the corresponding shaped hole 47A in the support 47, in such a way as to produce a substantially rectilinear and radial sliding of its own end hook 23U in a radial direction with respect to the curved support 47 and outwards from the support.

Figure 1:
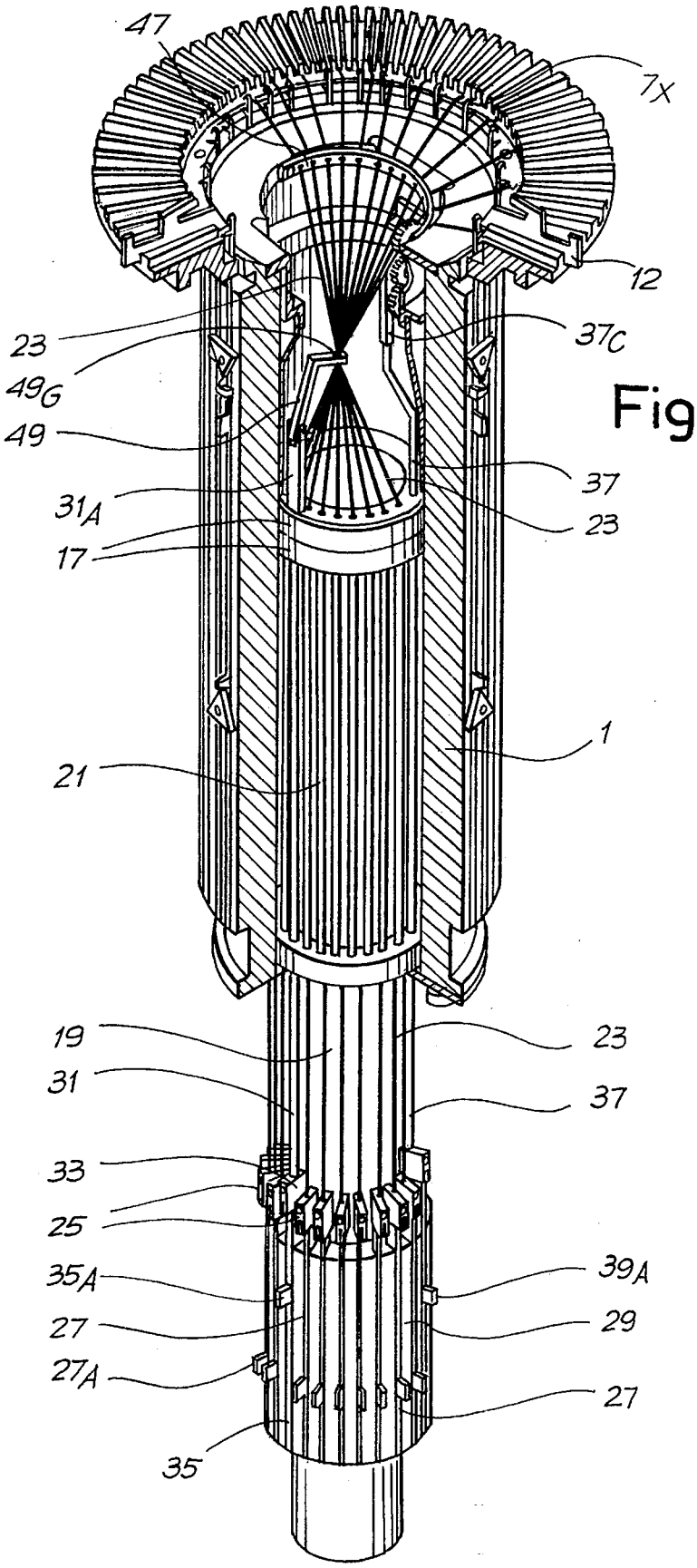
FIGS. 1 to 5 are perspective views, with parts removed, of the needle cylinder and elements of the device in various stages of working for the initial formation of a closed toe.
Figure 2:
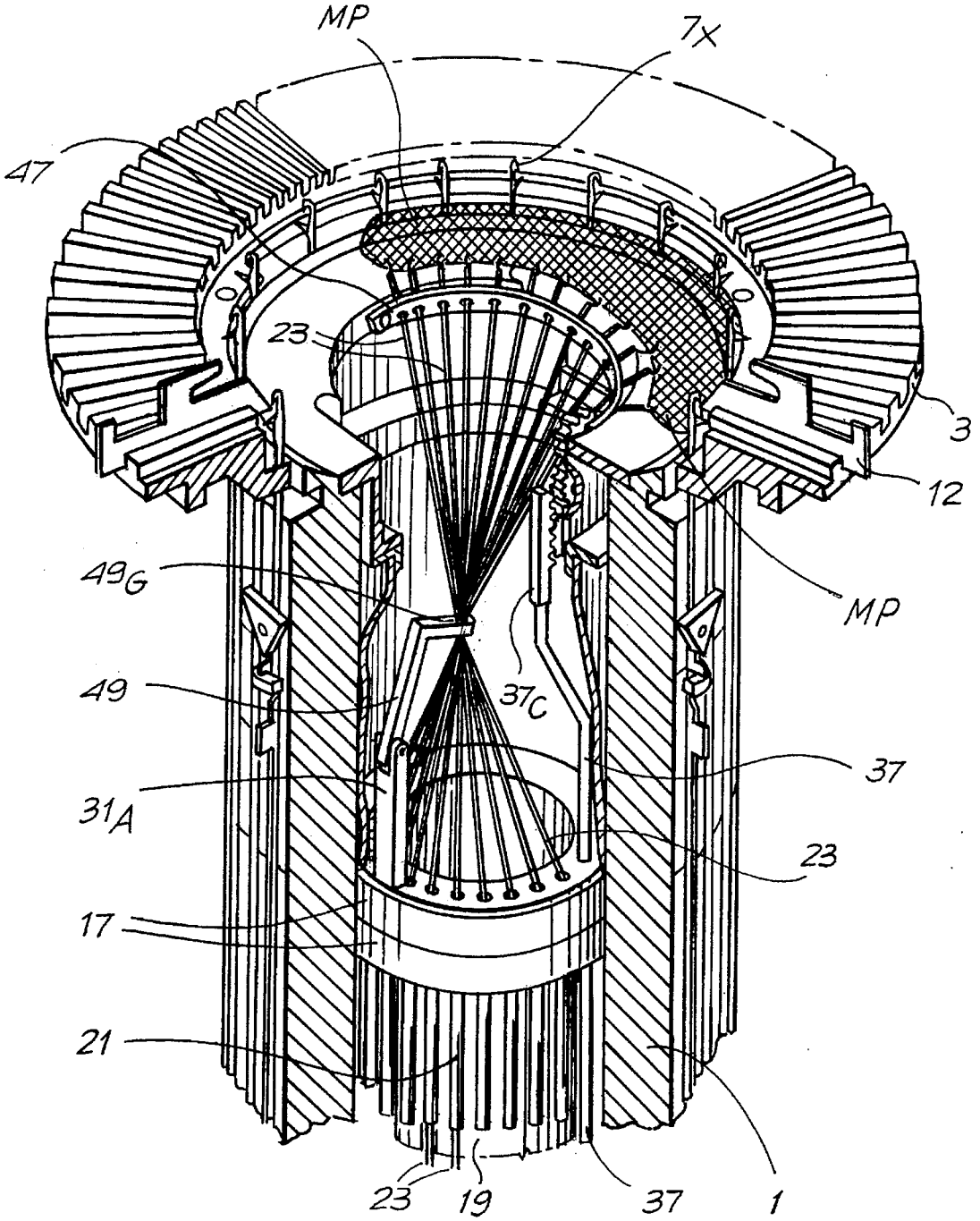
Figure 3:
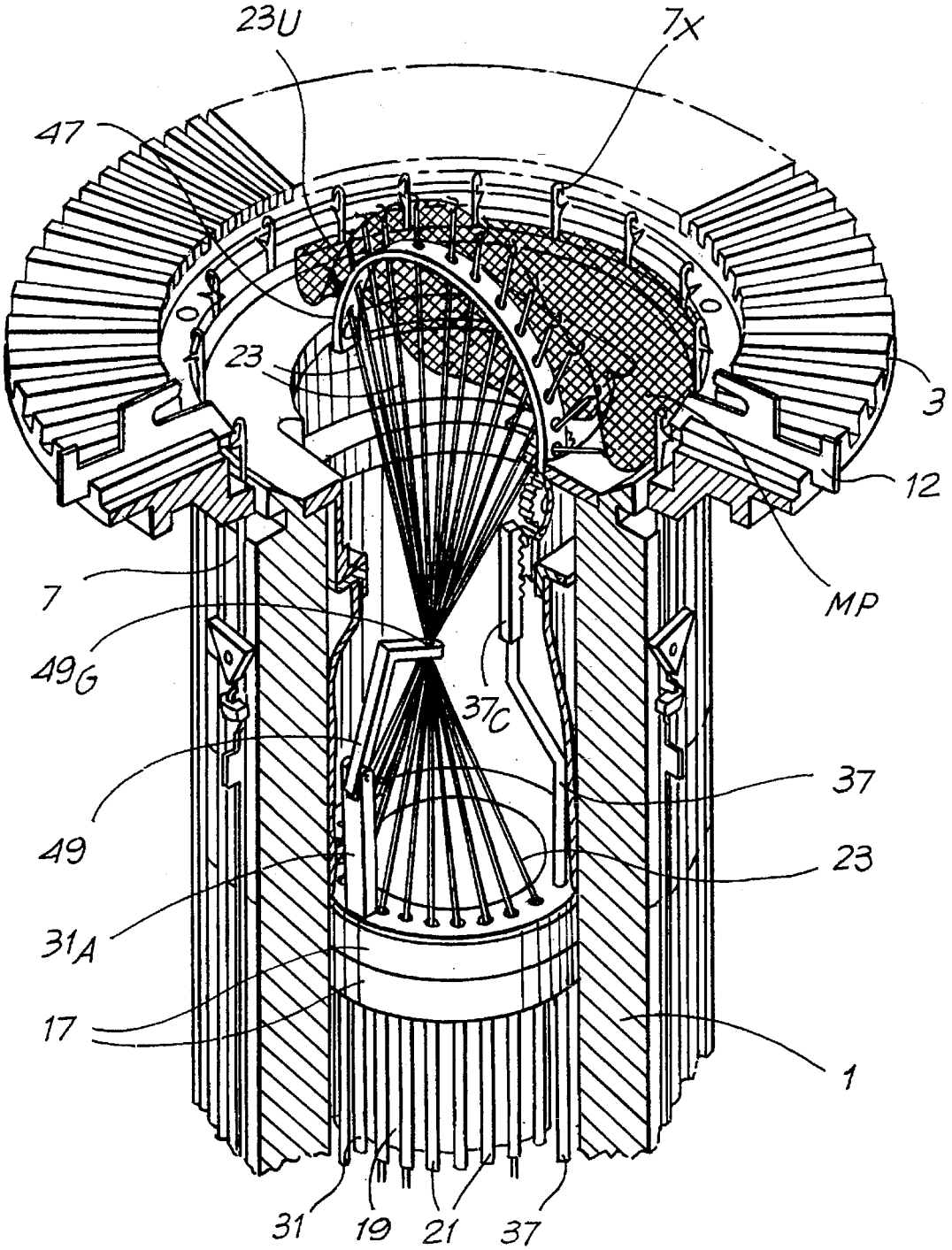
Figure 4:
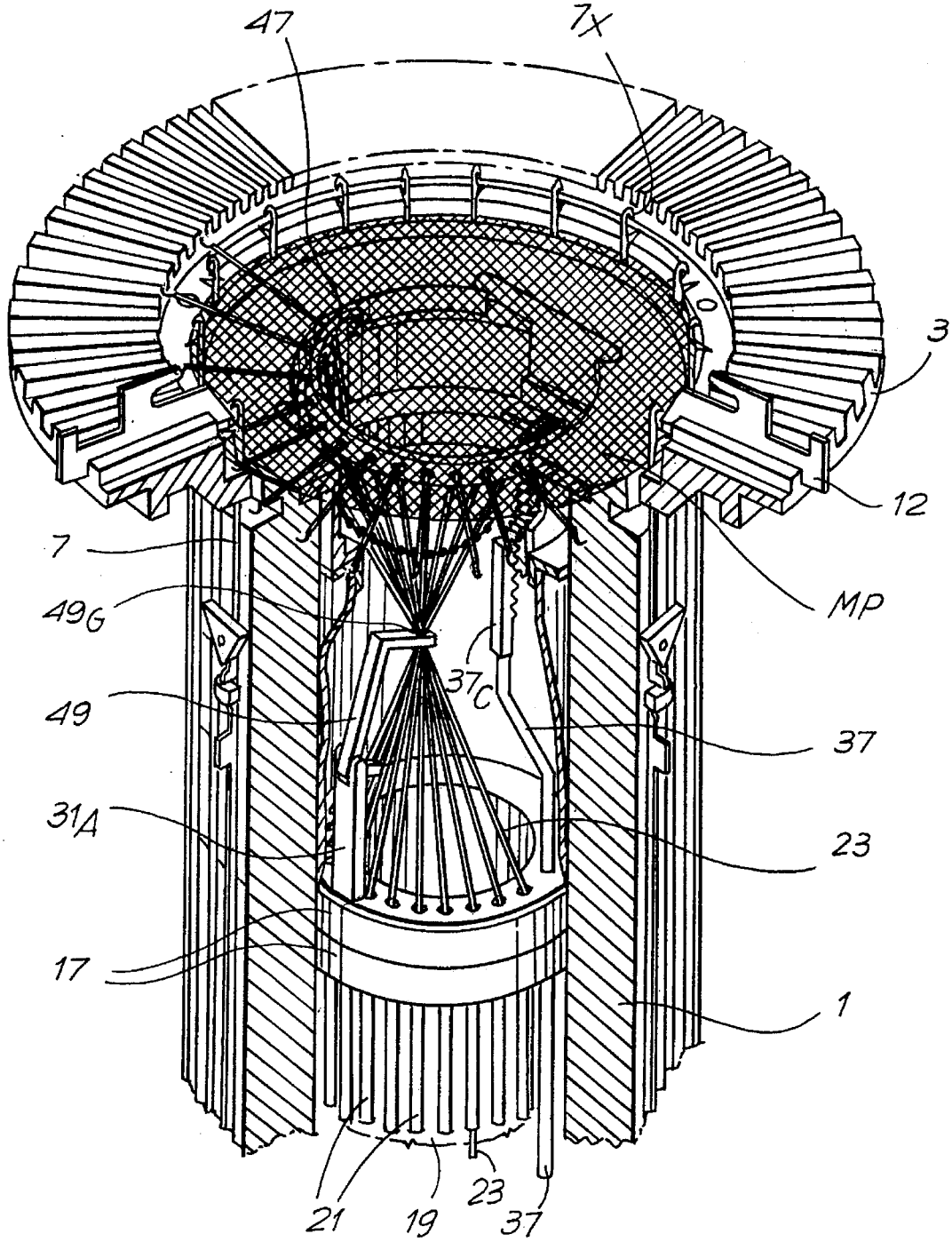

In the initial working conditions, the traversing element 49 is positioned as shown in FIG. 6, in other words it is inclined with the centred guide means 49G substantially in the area of the axis of the needle cylinder, the support 47 being moved by the rack 37C into the position opposite that in which the rigid rod 31 is located (see FIG. 6 and FIG. 1). In these conditions, the working of the toe of the stocking can commence, with the distribution of the thread to the needles 7X of an arc diametrically opposite that in which the rods 23 and the tubes 21 for guiding them are located. In the initial conditions, the hooks 23U are made to project until they reach a position between the needles 7X prepared to receive the thread initially for the formation of a pocket of the article, with a reciprocating movement of the needle cylinder; the support 47 is turned over to the side of the needles 7X, in other words in the conditions shown in FIGS. 1, 2, 6, 7. As soon as working has commenced, the hooks 23U are gradually withdrawn from the position shown in FIGS. 1, 7 and 12 to the position shown in FIGS. 2, 7 and 13, in which the hooks are moved through a limited distance from the working area of the needles and can allow a pocket to be formed as shown in FIGS. 2 and 13. In these conditions, a sufficient quantity of fabric (FIG. 8) is formed, extending between the needles 7X and the hooks 23U with a substantially U-shaped vertical section; this portion MP of the article, intended to form the initial closure of the end of the tubular article to be manufactured subsequently, is extended through a distance such that it can then be stretched across the needle cylinder, by means of an angular movement of the support 47 from the position shown in FIG. 6 to the intermediate position shown in FIG. 8 and then to the overturned position shown in FIG. 9, the hooks being still in the withdrawn conditions as shown in FIG. 6 instead of the projecting position shown in FIG. 7. For turning the support over in this way, with the hooks 23U still projecting or being withdrawn towards the support, it will be useful to raise the dial 5 temporarily as shown in FIG. 8. After the support 47 has reached the overturned position shown in FIG. 9 (which is symmetrical with respect to the position shown in FIGS. 6 and 7), the hooks 23U are located, or are made to project until they are located, next to the needles of the arc opposite that of the needles 7X which have commenced the working of the pocket MP. In these conditions where the hooks 23U project as shown in FIG. 9, the needles opposite the needles 7X come into operation and engage the hem initially engaged by the hooks 23U for the formation of the pocket MP. In this way, by the engagement of the initial hem of the pocket MP with the said needles opposite the needles 7X, the fabric of the pocket MP is positioned in a configuration in the form of a diaphragm as shown in FIG. 14, transversely and inside the circumferential working area of the needles.

At this point the working of the fabric, not only by the needles of the arc 7X but by all the needles of the needle cylinder, commences for the formation of the tubular article. It should be noted that the formation of the pocket takes place initially with a limited number of needles, in the arc of the needles 7X, while all the needles commence working only after the engagement of the initial article by the hooks for the formation of the pocket MP. The pocket may be formed with widening sections and narrowing sections by including and excluding from the working symmetrical needles 7X of the arc of needles 7X working the pocket with a reciprocating motion. The knitting of the tubular article commences after the hooks 23U, which have been turned over with the support 47, have transferred the initial hem of the fabric MP to some of the needles in the position opposite that of the arc of needles 7X which have worked the pocket, to engage the stitches held by the hooks 23U and then to start the formation of the tubular article.

Figure 5:
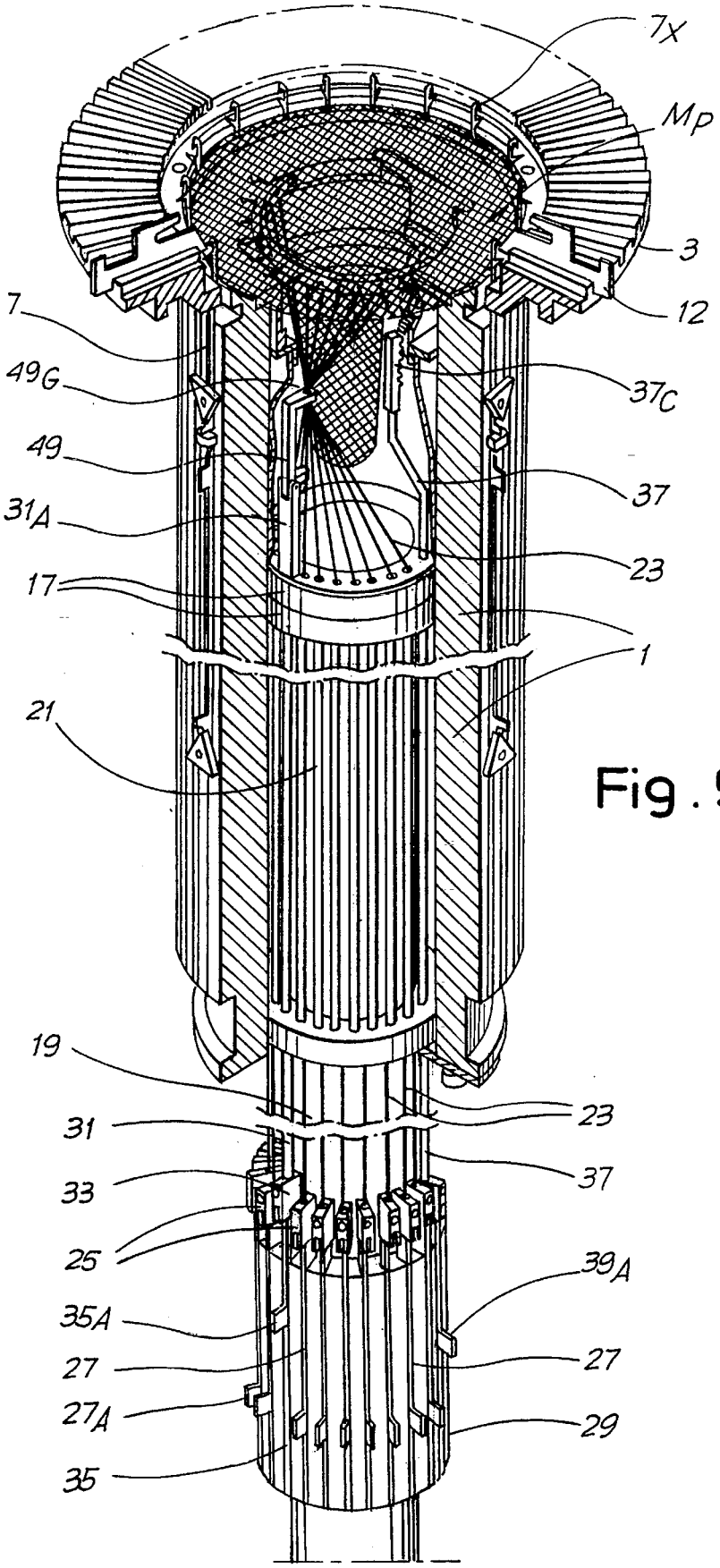
Figure 7:
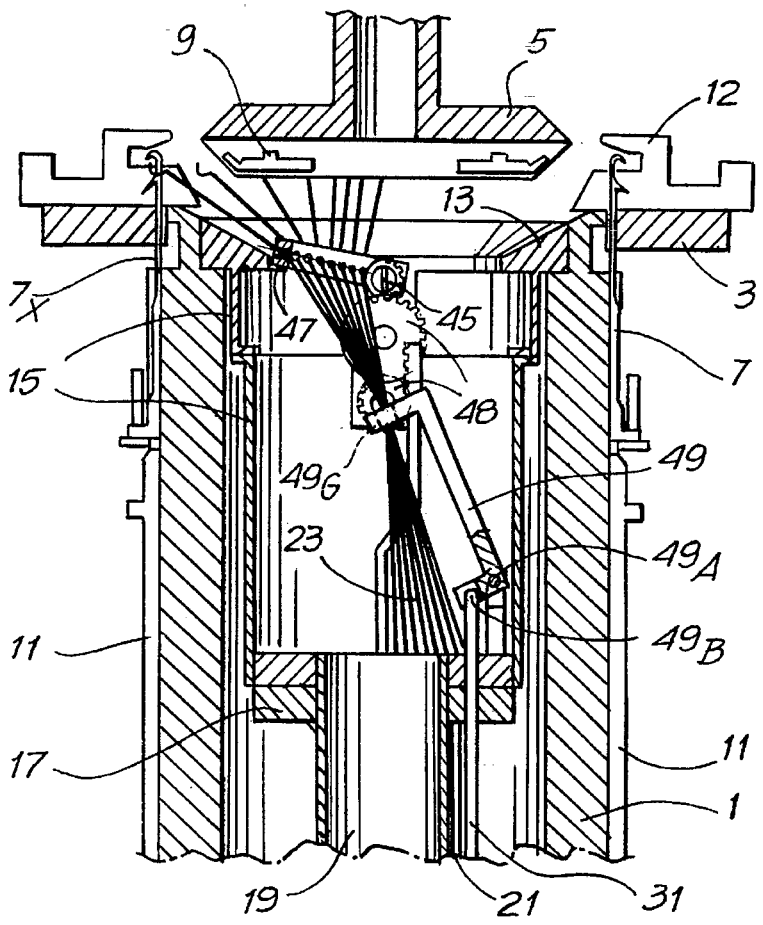
Figure 7A:
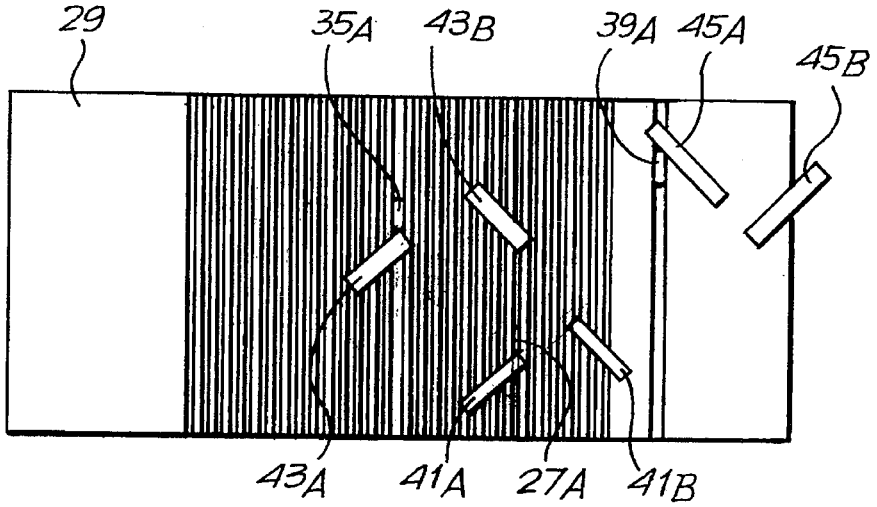

For the formation of the tubular article, the article must, as usual, be tensioned and extended inside and along the needle cylinder. In particular, the article must be able to advance inside the tube 19, in which a pneumatic downward suction may be provided to keep the stitches of such a tubular article under tension as they are formed. To permit this, the space inside the collar 15 has to be made sufficiently clear after the overturning of the support 47 from the configuration in FIG. 6 to the configuration in FIG. 9, and after the transfer of the stitches engaged by the hooks 23U to the needles which commence the tubular working as stated above. This is achieved by the movement of the element 49 from the configuration in which the guide 49G is approximately on the axis of the needle cylinder to the configuration shown in FIGS. 5 and 10, in which the centred guide means 49G has been moved from the area of the axis of the needle cylinder to an area displaced towards the collar 15, enabling the article to advance into the interior of the tube 19, with pneumatic tensioning.

After the formation of the tubular article, closed at the toe at the start of its formation, and after the release of the needles which have formed this article, the support 47 is turned over again from the configuration in FIG. 10 to the configuration in FIG. 6, and the element 49 is again moved from the configuration in FIG. 10 to the configuration shown in FIG. 6 and in FIGS. 1, 2, etc. The support is moved again in the manner described above by the raising of the dial or disc 5 carrying the hooks 9. The hooks 23U return to their position, first partially and then completely projecting in a centrifugal radial direction under the action of the cams 41A which act on the stubs 27A of the rods 23, to repeat the operation of forming the initial pocket for closing the initial end of the article.

The hooks 23U can be made to approach the support 47 more closely than those shown in FIG. 10, but in such a way that they do not interfere with the formation of the tubular article in the conditions shown in FIG. 10.

It is to be understood that the drawing shows only an example provided solely as a practical demonstration of the invention, and that this invention may be varied in its forms and dispositions without departure from the scope of the guiding concept of the invention.

I claim:

1. A device for automatic initial formation of a closed toe in a tubular knitted article directly on a circular knitting machine having a needle cylinder on which the article is formed, the device positioned within the cylinder and comprising a plurality of hooks for engaging an initial hem of a pocket formed by the needles of a sector covering approximately a semicircumference of the cylinder, and for transferring the initial hem to the needles of the opposite sector of needles, prior to the start of circular knitting of the article, wherein the hooks (23U) are disposed at ends of rods (23) which are elastically flexible; the rods (23) are movable longitudinally by cams of a ring of cams arranged coaxial with the needle cylinder at end opposite the hooks; one of the guide means provided for a curved support (47) which is hinged for oscillating about an axis diametric with respect to the circumferential working area of the needles (7, 7X) of the needle cylinder (1) is provided for the axial sliding of the rods, radial sliding passages (47A) for the individual rods being formed radially in this support, and means provided for moving the support between two substantially opposite positions to cause overturning of the hooks and consequently transfer of the hem.

2. The device as claimed in claim 1, wherein means for guiding the rods is a traversing element (49) with a guide means (49G) for moving the rods (23) into a working position substantially central with respect to the needle cylinder, and into a position displaced to one side in an inactive state in order to permit the passage and the tensioning—of the article being formed after the production of the toe.

3. The device as claimed in claim 2, wherein means for guiding the rods (23) comprise tubes (21) or equivalent elements in which the rods (23) are guided parallel to the axis of the cylinder, the said tubes (21) or equivalent elements being disposed over an are of the circumference of the section of the needle cylinder.

4. The device as claimed in claim 2, wherein said guide means (49G) on the traversing element (49) brings the rods (23) together or at least closer to each other.

5. The device as claimed in claim 3, wherein means for guiding the rods (23) comprise tubes (21) or equivalent elements in which the rods (23) are guided parallel to the axis of the cylinder, the tubes (21) or equivalent elements being disposed over an arc of the circumference of the section of the needle cylinder.

6. The device as claimed in claim 1 or 2, wherein means for moving and guiding the rods are disposed over an arc of the circumference of the needles, on one side of the axis of the support where the hooks are in an inactive position.

7. The device as claimed in claim 1, wherein means for guiding the rods (23) comprise tubes (21) or equivalent elements in which the rods (23) are guided parallel to the axis of the cylinder, the tubes (21) or equivalent elements being disposed over an arc of the circumference of the section of the needle cylinder.

* * * * *